US006686682B2

(12) United States Patent
Weon

(10) Patent No.: US 6,686,682 B2
(45) Date of Patent: Feb. 3, 2004

(54) CATHODE IN CATHODE RAY TUBE

(75) Inventor: Byung Mook Weon, Kumi (JP)

(73) Assignee: LG. Philips Displays Korea Co., Ltd., Kyongsangbuk-Do (KR)

( * ) Notice: Subject to any disclaimer, the term of this patent is extended or adjusted under 35 U.S.C. 154(b) by 29 days.

(21) Appl. No.: 10/134,490

(22) Filed: Apr. 30, 2002

(65) Prior Publication Data

US 2003/0127962 A1 Jul. 10, 2003

(30) Foreign Application Priority Data

Jan. 4, 2002 (KR) ..... P2002-0000419

(51) Int. Cl.[7] ..... H01J 1/04
(52) U.S. Cl. ..... 313/346 R; 313/270; 313/337
(58) Field of Search ..... 313/346 R, 270, 313/337

(56) References Cited

U.S. PATENT DOCUMENTS 6,016,026 A 1/2000 Lee

*Primary Examiner*—Vip Patel
(74) *Attorney, Agent, or Firm*—Birch, Stewart, Kolasch & Birch, LLP

(57) ABSTRACT

Disclosed is a cathode in a cathode ray tube including a cathode sleeve having a heater inside, a base metal supported by the cathode sleeve so as to be formed at an upper end of the cathode sleeve, and an emission layer formed on the base metal, wherein the emission layer includes alkaline earth metal oxide and $Y_2O_3$-doped $ThO_2$. The present invention enables to prevent the degradation of endurance of the cathode by carrying out the generation and extinction of free Ba stably.

5 Claims, 9 Drawing Sheets

| | Operation time(t) | 0 | 24 | 100 | 500 | 1000 | 1200 |
|---|---|---|---|---|---|---|---|
| The present invention | Maximum cathode current | 100% | 93% | 93% | 86% | 80% | 79% |
| | Ba(t)/Ba(t=0) | 100% | | 98% | | 73% | 69% |
| The related art | Maximum cathode current | 100% | 91% | 91% | 79% | 73% | 74% |
| | Ba(t)/Ba(t=0) | 100% | | 94% | | 77% | 66% |

FIG.13

| | Melting heat (kj/mol) | Evaporation heat (kj/mol) | Heat conductivity (W/cm k) |
|---|---|---|---|
| Ba | 7.750 | 142.0 | 0.184 |
| Th | 16.10 | 514.4 | 0.540 |

CATHODE IN CATHODE RAY TUBE

This application claims the benefit of the Korean Application No. P2002-00419 filed on Jan. 4, 2001, which is hereby incorporated by reference.

BACKGROUND OF THE INVENTION

1. Field of the Invention

The present invention relates to a cathode in a cathode ray tube having a high current density and a long endurance.

2. Discussion of the Related Art

Generally, a cathode ray tube, as shown in FIG. 1, includes a panel 1 to which a florescent film is attached, a shadow mask 4 coupled with an inner face of the panel 1, and a funnel 2 having a neck pipe 3 backwardly like a funnel. An electron gun 5 having a cathode 10 inside is in the neck pipe 3 so as to form electron beams by concentrating hot electrons irradiated from the cathode 10. The electron beams are controlled by a magnetic field of a deflection yoke 6 attached outside a neck part and color selection is carried out by the shadow mask 4 so as to collide with a predetermined spot of the fluorescent film to make a fluorescent material emit lights. Hence, an image is displayed by the cathode ray tube.

Moreover, the cathode 10, as shown in FIG. 2, includes an emission layer 12, a base metal 14, a heater 16, a sleeve 19, and a holder 18.

In this case, an electron emission material of the emission layer 12 is one of BaO, SrO, CaO and the like, which is hygroscopic to react with water aggressively so as to be changed into $Ba(OH)_2$, $Sr(OH)_2$, $Ca(OH)_2$, or the like. Such a hydroxide keeps on absorbing crystallization water so as to reduce porosity required for hot electron emission.

Substantially, a method of changing alkaline earth metal carbonate such as $Ba(OH)_2$, $Sr(OH)_2$, $Ca(OH)_2$, or the like into oxide instead of the hygroscopic material is used for the fabrication of the cathode. A method of fabricating a cathode in CRT according to a related art is explained as follows centering on the emission layer.

First, alkaline earth metal carbonate such as CaCO3, SrCO3, CaCO3, or the like is spin-coated on the base metal 14 containing a small quantity of a reducer such as Mg, Si, Al, W and the like, and then activated by heating at about 900~1000° C.

Carbonate is dissolved into oxide and carbon dioxide by the above activation process as shown in the following Chemical Equation 1. In this case, carbon dioxide is removed by pumping or adsorption by a getter.

$$(Ba, Sr, Ca)CO_2 \rightarrow (Ba, Sr, Ca)CO_3 \quad \text{[Chemical Equation 1]}$$

After the activation process, an aging process is carried out by heating at a high temperature between about 800~1050° C. as well as applying a suitable electric field for stable electron emission.

The aging process is carried out for the formation of free Ba on a cathode surface and the provision of a stable and optimal electron emission environment, whereby BaO is reduced by a small quantity of the reducer such as Mg, Si, Al, W, or the like in the base metal so as to form free Ba.

Chemical Equation 2 shows an example of chemical reaction between BaO and Mg as the reducer.

$$BaO+Mg \rightarrow Ba+MgO \quad \text{[Chemical Equation 2]}$$

In the aging process, BaO can be dissolved into Ba and O directly by electrolysis, which in shown in Chemical Equation 3.

$$BaO \rightarrow Ba+O \quad \text{[Chemical Equation 3]}$$

The cathode in CRT is fabricated through the activation and aging processes. Oxygen(O) formed in the aging process is removed in vacuum due to evaporation at the cathode surface and ion impact, whereby excessive barium(Ba) exists in the cathode so as to be free Ba. Thus, the remaining free Ba is a positive charge to generate electrons so as to become a generating source of the emission electrons relatively.

The formation process of the emission electrons is explained in detail as follows.

In defect reaction, free Ba has a meaning equivalent to oxygen vacancy. Namely, the formation of free Ba is accompanied with that of oxygen vacancy, whereby electrons are generated. Specifically, oxygen generates free electrons enabling to be emitted by the following chemical equation of vacancy forming reaction.

$$O^X_o \rightarrow {}^{1/2}O_2(g)+V^{\cdot\cdot}_O+2e^1 \quad \text{[Chemical Equation 4]}$$

The above equation is called a "defect reaction", which is used in discussion of electrochemical equilibrium in a solid constructed with ion bonds like a ceramic material. IN this case, a representation of the defect type and electrical property like the right notation is the "Kroger-Vink notation", in which upper and lower subscripts mean the electrical property and the defect type, respectively.

As known by the above equation, if oxygen($O^X_o$), which should be at an oxygen site, is removed by vacuum or reaction in the above aging process($O_2(g)$), oxygen vacancy ($V^{\cdot\cdot}_O$) is formed to be electrically positive. Hence, electron ($e^1$) is formed to make an electrical equilibrium so as to correspond to oxygen vacancy ($V^{\cdot\cdot}_O$). Therefore, the more oxygen is removed, the more electrons are formed. In this case, it is a matter of course that the supply source of electrons is free BA having the electrons substantially.

Yet, in the method of fabricating the cathode in CRT according to the related art, byproducts of high resistance like magnesium oxide as well as Ba are formed by the chemical reaction between BaO and reducer in the aging process, whereby a middle layer is formed at an interface between the emission layer and base metal. Such byproducts grow during operation endurance to be a reason for the generation of Joule heat, thereby evaporating free Ba from the emission layer.

Moreover, the cathode is operated at a high temperature, about 1000° C., whereby sintering between particles progresses gradually to make the particles coarse. Therefore, electro-conductivity of the emission layer and the pore conductivity of electrons are reduced, thereby degrading the endurance.

Furthermore, when the cathode operates at a high temperature, Ba or BaO may evaporate as well as loss of degradation may occur, whereby free Ba becomes extinct with ease.

In order to overcome the above problems or disadvantages, a method of fabricating a cathode by adding a specific additive to an emission layer has been proposed.

U.S. Pat. No. 5,075,589 discloses a method enabling to improve an electron emission characteristic by adding a micro particles such as $Y_2O_3$, $Sc_2O_3$, or rare-earth metal oxide(ex. $Eu_2O_3$) to an mission layer containing BaO and SrO.

And, Korean Patent No. 97-51633 discloses a cathode including an emission layer, of which main elements are an activation metal containing at least one of Mg, Si, Zr, Mn, W, and Th, its oxide, and BaO, containing at last one of SrO, CaO, ScO, and aluminum oxide.

Unfortunately, the above-disclosed methods are still inadequate in prohibiting sintering and evaporation of free Ba.

Thus, the degradation of endurance of the cathode depends on the generation and extinction of free Ba. Hence, required is a method enabling to control the mechanism of the generation and extinction of free Ba as well as prohibit middle layer and the sintering of particles.

SUMMARY OF THE INVENTION

Accordingly, the present invention is directed to a cathode in a cathode ray tube that substantially obviates one or more problems due to limitations and disadvantages of the related art.

An object of the present invention is to provide a cathode in a cathode ray tube enabling to prevent the degradation of endurance of the cathode by carrying out the generation and extinction of free Ba stably.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cathode in a cathode ray tube including a cathode sleeve having a heater inside, a base metal supported by the cathode sleeve so as to be formed at an upper end of the cathode sleeve, and an emission layer formed on the base metal, wherein the emission layer includes alkaline earth metal oxide and $Y_2O_3$-doped $ThO_2$.

Preferably, the alkaline earth metal oxide includes at least one of SrO, CaO, $Sc_2O_3$, and $Al_2O_3$ and BaO.

Preferably, the $Y_2O_3$-doped $ThO_2$ has a granularity between 0.5 and 2.5 $\mu$m.

Preferably, a doping concentration of $Y_2O_3$ in the $Y_2O_3$-doped $ThO_2$ is within 10 atom %.

Preferably, a content of the $Y_2O_3$-doped $ThO_2$ in the emission layer is between 0.01 and 0.10 weight %.

The present invention enables the cathode in the cathode ray tube to have a high current density and a long endurance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 7 to FIG. 11 illustrate test results comparing characteristics of cathodes in cathode ray tubes according to the present invention and related art, in which:

FIG. 7 illustrates a graph of a relative value of a maximum cathode current for an operating time;

FIG. 8 illustrates a graph of a mean time to failure (MTTF) in accordance with a content of an additive added to an electron emission material;

FIG. 9 illustrates a graph of a poisoning characteristic;

FIG. 10 illustrates a table of an AES (Auger electron spectroscopy) analysis for the relationship between a maximum cathode current and a BA content; and FIG. 11 illustrates a graph of an AES analysis of content variation of Ba and oxygen at a surface according to an operating time;

FIG. 13 illustrates a table of physical property of Ba and Th.

DETAILED DESCRIPTION OF THE INVENTION

Figure 1:
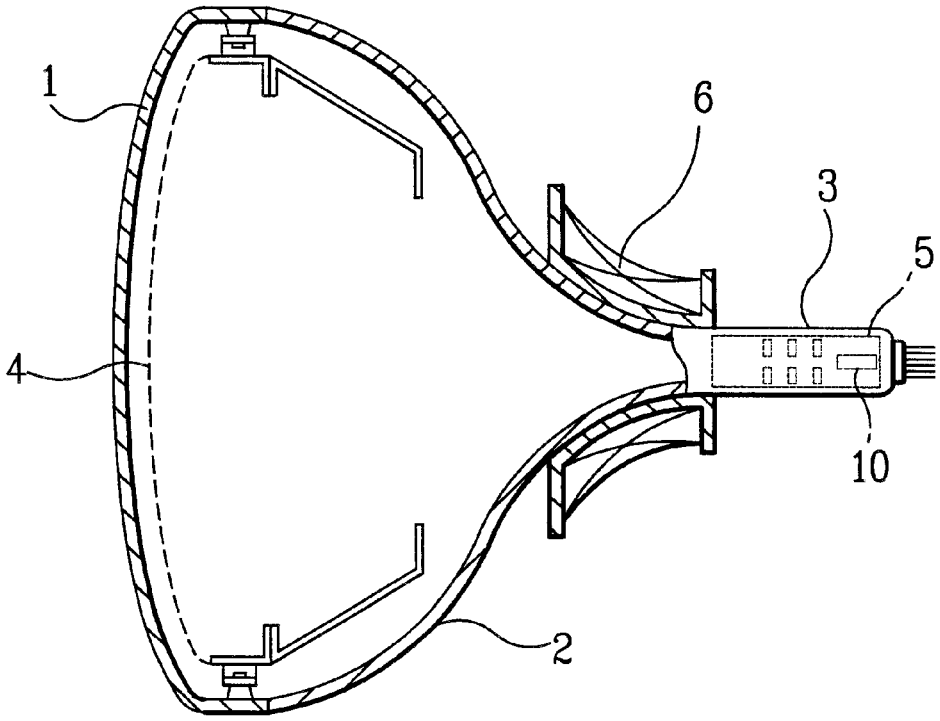
FIG.1 Related Art
FIG. 1 illustrates schematically a cross-sectional view of a general cathode ray tube.
Figure 2:
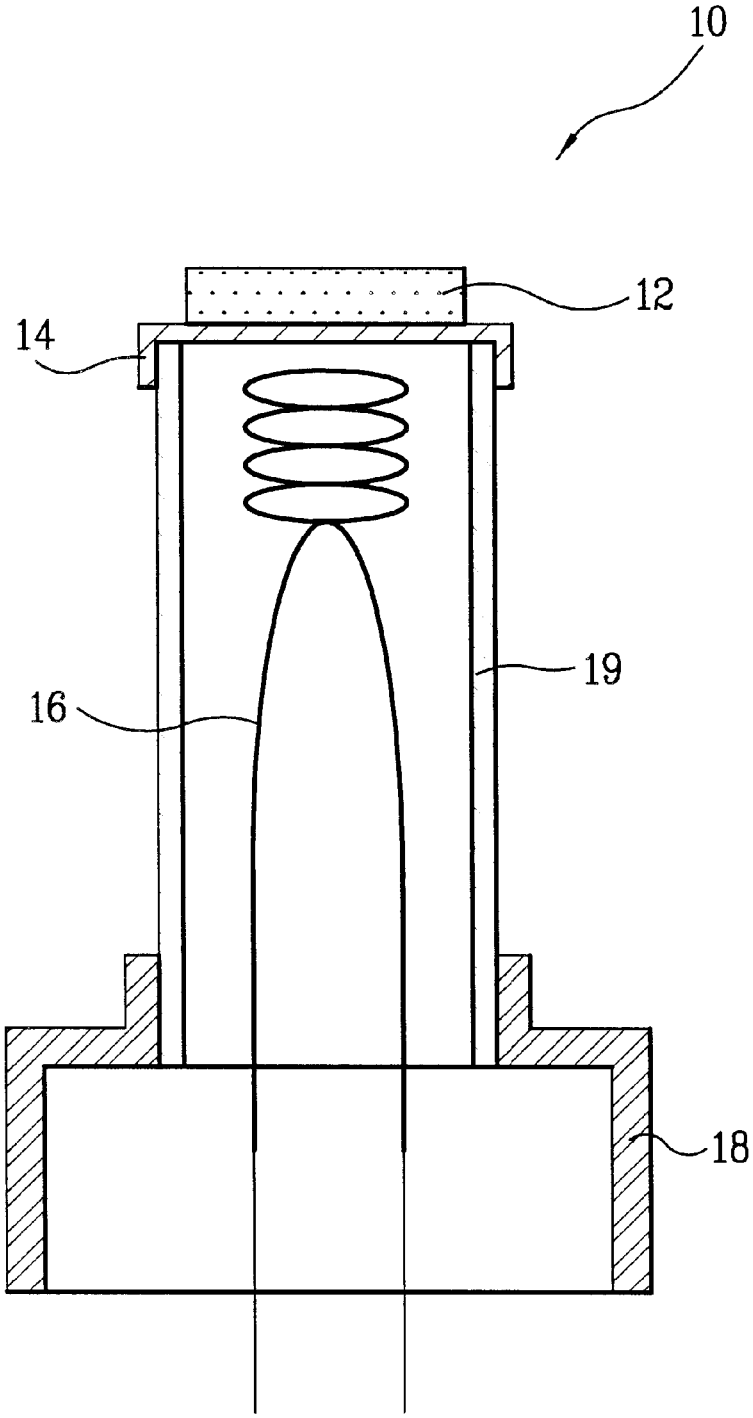
FIG.2 Related Art
FIG. 2 illustrates schematically a cross-sectional view of a cathode in a cathode ray tube according to a related art.

Reference will now be made in detail to the preferred embodiments of the present invention, examples of which are illustrated in the accompanying drawings. Wherever possible, the same reference numbers will be used throughout the drawings to refer to the same or like parts.

The present invention provides a cathode in a cathode ray tube(hereinafter abbreviated CRT) having an emission layer consisting of alkaline-earth metal oxide and $Y_2O_3$-doped $ThO_2$.

Namely, the present invention adds $Y_2O_3$-doped $ThO_2$ to the emission layer of the cathode in CRT, thereby enabling to realize a high current density and a long endurance of the cathode.

Generally, some materials having very high ion conductivity in ceramic materials are called fast ion conductors or solid electrolytes, in which a material enabling oxygen to be conducted fast is named oxygen ion conductor.

A count of defects of oxygen ion conductor is well controlled by a doping concentration, of which principle is explained by taking CaO-doped $ZrO_2$ known generally as oxygen ion conductor as an example.

When $ZrO_2$ is doped with a mole of CaO, as shown in Chemical Equation 5, oxygen vacancy amounting to 1 mole is formed in $ZrO_2$.

[Chemical Equation 5]

$$CaO \xrightarrow[ZrO_2]{} Ca''_{Zr} + V_{\ddot{O}} + O^{x}_{O}$$

As known in the above Chemical Reaction 5, when CaO is doped into $ZrO_2$, Ca occupies a Zr site for substitution. Thus, Ca of which bond number is 2 enters the site of Zr of which bond number is 1, whereby one bond number is excessive.

In this case, the excessive bond number 1 is supposed to be a site to which oxygen is bonded. Yet, there is one oxygen in equilibrium. And, the bond number 1 fails to join the bonding so as to be vacant. Therefore, the oxygen vacancy becomes a moving path of oxygen atom, thereby enabling to conduct oxygen fast.

Meanwhile, the formation of free BA, as mentioned in the foregoing description, becomes accompanied with the formation of oxygen vacancy so as to generate electrons. Considering such a mechanism, oxygen vacancy as the moving path of oxygen is generated more sufficiently when oxygen ion conductor is added to the emission layer. Accordingly, the movement and removal of oxygen are carried out smoothly, thereby enabling to increase a current density of emission electrons.

Moreover, the movement and removal of oxygen are carried out continuously for an operation endurance, thereby enabling to perform electron emission of the cathode stably and lastingly.

The present invention adds $Y_2O_3$-doped $ThO_2$ among oxygen ion conductors to an electron emission layer of a cathode in CRT, and the corresponding doping reaction is shown in the following Chemical Equation 6.

[Chemical Equation 6]

$$YO_{1.5} \xrightarrow[ThO_2]{} Y''_{Th} + \frac{1}{2}V_{\ddot{O}} + \frac{1}{2}O^{x}_{O}$$

In this case, ThO2 and Y2O3 applied to the present invention have excellent poison-resistance, thereby preventing BaO from reacting with remaining gas inside CRT to avoid loss of degradation.

Figure 3:
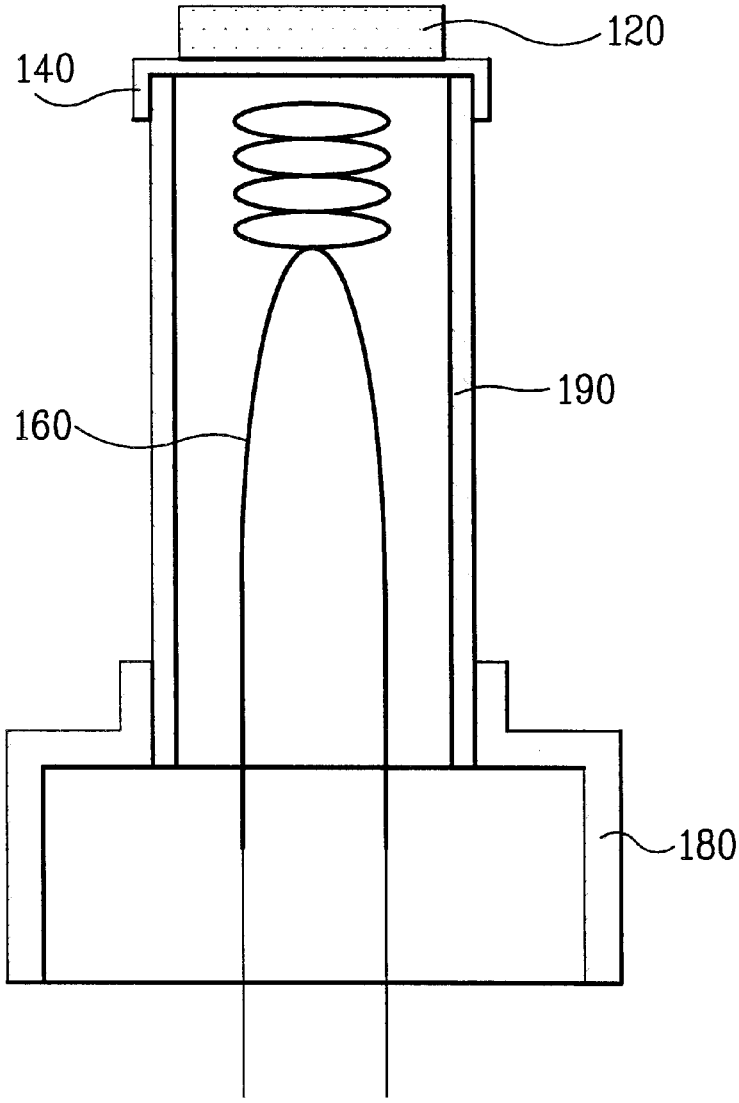
FIG. 3 illustrates schematically a cross-sectional view of a cathode in a cathode ray tube according to the present invention.

FIG. 3 illustrates schematically a cross-sectional view of a cathode in a cathode ray tube according to an embodiment of the present invention.

Referring to FIG. 3, a cathode in a cathode ray tube according to an embodiment of the present invention includes a cathode sleeve 190 having a heater 160 inside, a base metal 140 formed at an upper end of the cathode sleeve 190 and supported by the cathode sleeve 190, and an emission layer 120 formed on the base metal 140 and supported by the base metal 140. And, the emission layer 120 is formed of alkaline earth metal oxide and $Y_2O_3$-doped $ThO_2$.

In this case, the heater 160 as a heat source may be formed such that alumina(A1203) as an insulating layer is coated on a heat-resistant line of which main element is tungsten(W) And, the cathode sleeve 190 transfers heat to the base metal 140 from the heater 160 and may be formed of Ni—Cr as main elements.

The base metal 140 helps the reduction of the emission layer 120, and may be formed of Ni as a main element and a small quantity of reducer such as Mg, Si, or the like. Besides, a holder 180 is formed at a lower part of the sleeve 190 to support.

Figure 4:
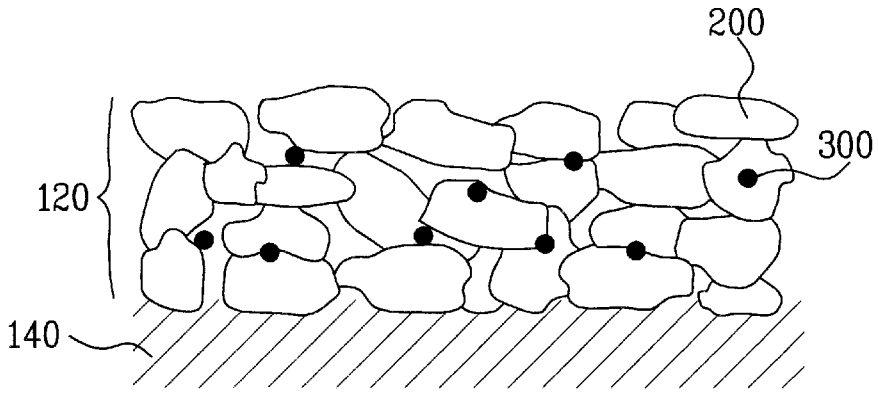
FIG. 4 illustrates a diagram of an mission layer constructing a cathode in a cathode ray tube according to the present invention.

In the emission layer 120, as shown in FIG. 4, $Y_2O_3$-doped $ThO_2$ 300 is scattered evenly among all in alkaline earth metal oxide 200. Alkaline earth metal oxide preferably contains BaO as a main element and at least one of SrO, CaO, $Sc_2O_3$, and $Al_2O_3$. And, a particle of $Y_2O_3$-doped $ThO_2$ 300 preferably has a granularity between 0.5~2.5 $\mu$m.

Moreover, a doping concentration of $Y_2O_3$ in $Y_2O_3$-doped $ThO_2$ 300 is preferably within 10 atom %.

Figure 5:
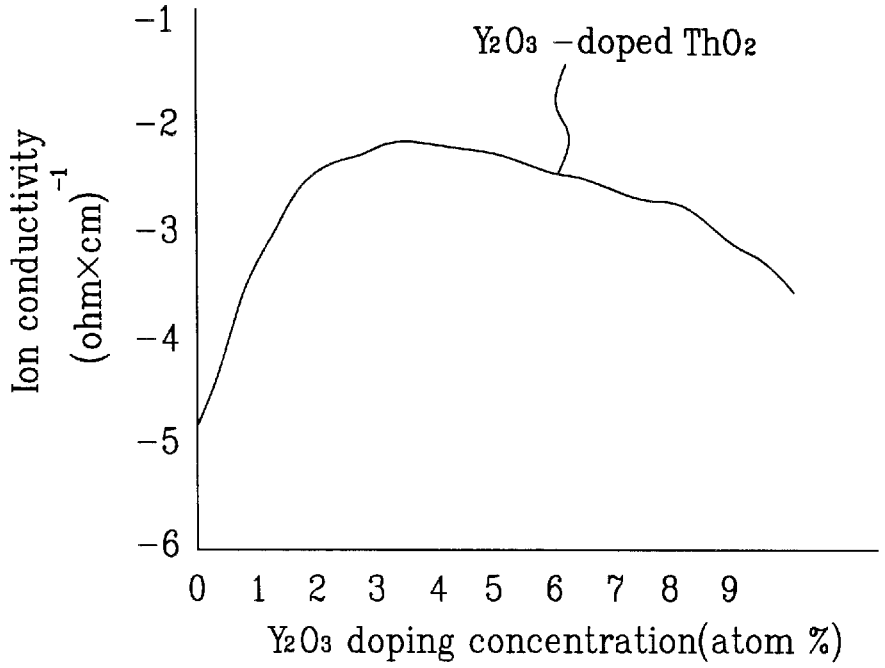
FIG. 5 illustrates a graph between an ion conductivity and a doping concentration of $Y_2O_3$ according to the present invention.

FIG. 5 illustrates a graph between an ion conductivity and a doping concentration of $Y_2O_3$ according to the present invention.

Referring to FIG. 5, as ion conductivity increases, it is easy to remove oxygen so as to generate emission electrons with ease. When a doping concentration exceeds 10 atom %, as shown in FIG. 5, ion conductivity is reduced below 10 [ohm×cm]−5 like the undoped case. More preferably, the doping concentration of $Y_2O_3$ is 2 to 6 atom %.

The emission layer consisting of alkaline earth metal oxide and $Y_2O_3$-doped $ThO_2$ is fabricated by the following process.

First, a micro quantity of $Y(NO_3)_3$ is mixed with $Th(NO_3)_4$ for about 24 hours for even dispersion.

The mixture is then put in alkaline earth nitrate[$(Ba,Sr,Ca)(NO_3)_2$] together with a predetermined alcohol and additive so as to prepare a suspension. And, the emission layer is formed with the suspension on the base metal. In this case, an average density and a volume of the emission layer are preferably about 0.95 mg/mm$^3$ and about 0.59 mm$^3$ (height 0.07 mm, diameter 1.64 mm).

Thereafter, activation and aging processes are carried out so as to complete the emission layer through the transformation from carbonate to oxide.

The following Chemical Equation 7 shows a progress that $Y(NO_3)_3$-doped $Th(NO_3)_4$ is transformed into $Y_2O_3$-doped $ThO_2$ in the process of the activation and aging.

1. $Y(NO_3)_3$-doped $Th(NO_3)_4 + 2Na_2CO_3 \rightarrow Y_2(CO_3)_3$-doped $Th(CO_3)_2 + 4NaNO$(removed)

2. $Y_2(CO_3)_3$-doped $Th(CO_3)_2 \rightarrow Y_2O_3$-doped $ThO_2 + 2CO_2$(removed) [Chemical Equation 7]

It is checked whether $Y_2O_3$-doped $ThO_2$ constructing the above-fabricated emission layer is properly doped with $Y_2O_3$ by X-ray fluorescence spectroscopy(XRF).

XRF is a kind of electron spectroscopy finding component elements and chemical bonds at a solid surface and interface, and used widely in the study of metal, catalyst, semiconductor material, ceramics, thin film, polymer film, and the like. Bond energy of a specific element inside a substance depends on a chemical environment. In other words, when a chemical bonding state of atoms varies, a bonding energy value varies within several eV as well. Such a varied value enables to check the states of chemical bond and valence electrons.

Figure 6:
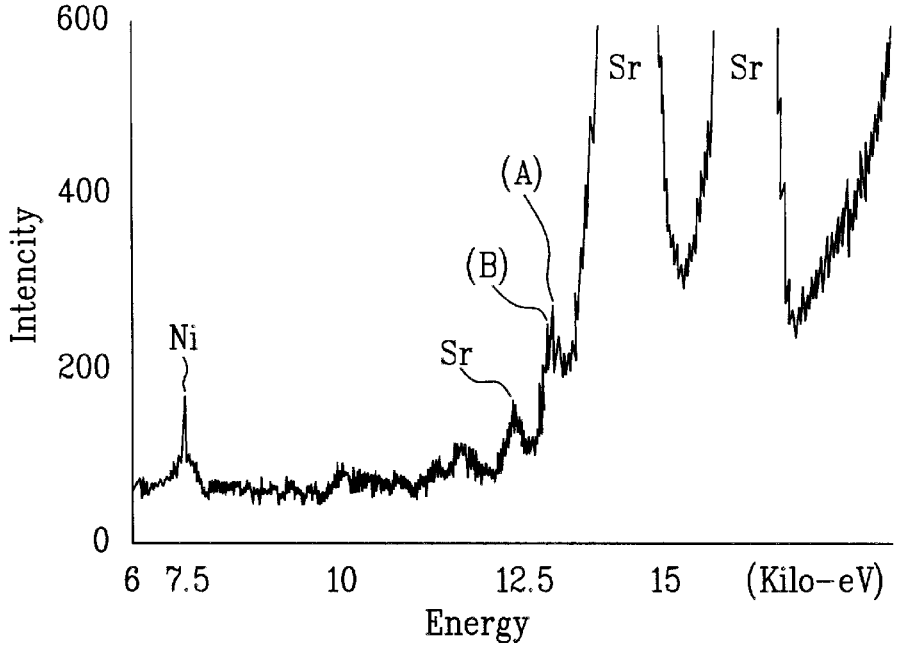
FIG. 6 illustrates a graph of an analysis of $Y_2O_3$-doped $ThO_2$ by X-ray fluorescence spectroscopy(XRF) according to the present invention.

FIG. 6 illustrates a graph of an analysis of $Y_2O_3$-doped $ThO_2$ by X-ray fluorescence spectroscopy(XRF) according to the present invention.

Referring to FIG. 6, a peak of Th in $ThO_2$ appears at (A), while another peak of Th shows up at (B) if $ThO_2$ is doped with a small quantity of $Y_2O_3$. Therefore, it is easily checked by the above method whether $ThO_2$ is doped with $Y_2O_3$.

Besides, SIMS(secondary ion mass spectroscopy) is also available for the judgment.

In order to check whether a performance of the cathode (hereinafter called 'the present invention') in CRT having the emission layer fabricated by the above method is improved or not, the present invention is compared through various tests to a cathode(hereinafter called 'first related art') in CRT having an emission layer consisting of alkaline earth metal oxide only and another cathode(hereinafter called 'second related art') in CRT having an emission layer formed of alkaline earth metal oxide to which Th is added.

FIG. 7 to FIG. 11 illustrate test results comparing characteristics of cathodes in cathode ray tubes according to the present invention and related art.

Figure 7:
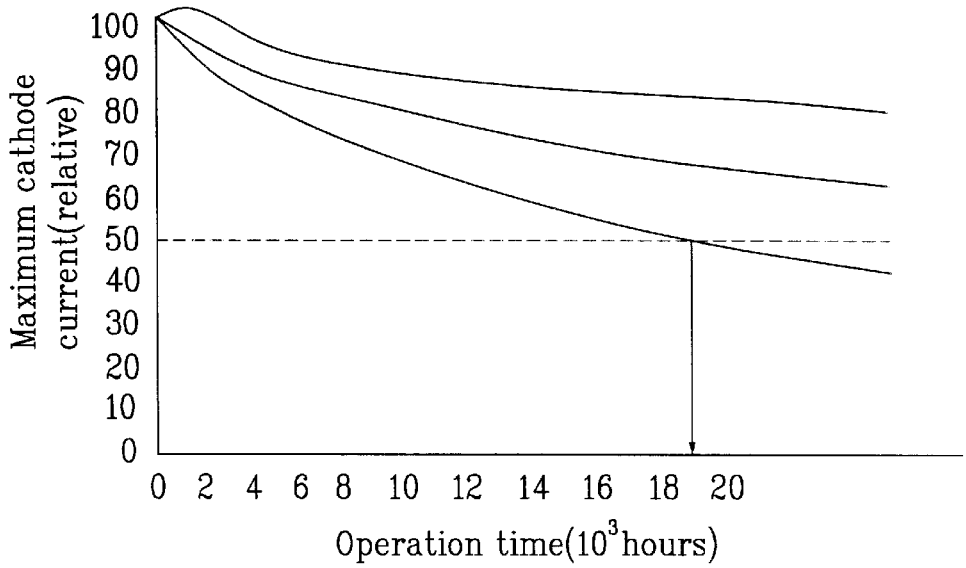

FIG. 7 illustrates a graph of a relative value of a maximum cathode current for an operating time.

Referring to FIG. 7, compared to the first and second related arts a and b, the present invention c has a big maximum cathode current of which decreasing quantity is small to the contrary.

Figure 8:
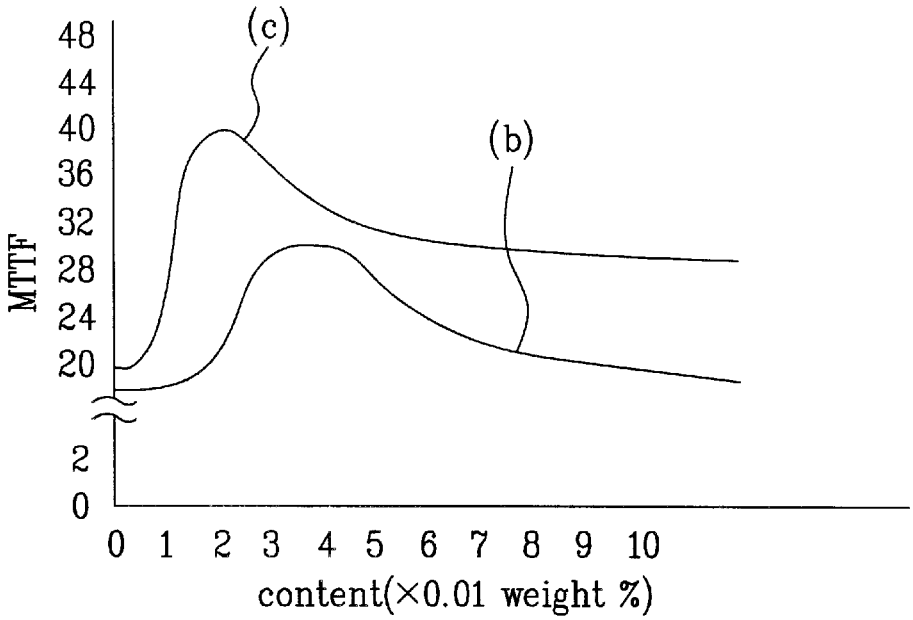

FIG. 8 illustrates a graph of a mean time to failure (MTTF) in accordance with a content of an additive added to an electron emission material.

MTTF means a time that a maximum cathode current variance corresponds to 50% of an initial value. It is a matter of course that long MTTF is more advantageous.

The second related art b, as shown in FIG. 8, has maximum 30,000 hours at about 0.04 weight % of an additive Th content. And, the present invention c, has maximum 40,000 hours at about 0.02 weight % of an additive $Y_2O_3$-doped $ThO_2$ content.

Moreover, MTTF of the present invention c is longer than that of the second related art b within a content range between 0.01 and 0.10 weight % of a $Y_2O_3$-doped $ThO_2$. Such a content range is preferable. More preferably, the content range is 0.02 weight % having the maximum time.

Figure 9:
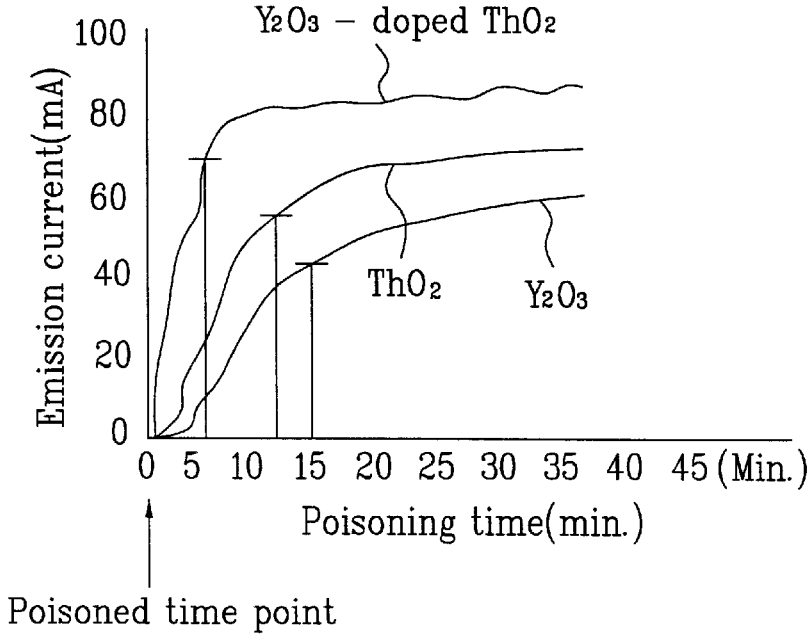

FIG. 9 illustrates a graph of a poisoning characteristic, in which a resistivity against poisoning is known by looking into a time for recovering from a poisoned time point after an emission current is poisoned.

Referring to FIG. 9, $ThO_2$ is recovered faster than $Y_2O_3$. And, $Y_2O_3$-doped $ThO_2$ has the fastest recovery time. Times taken for about 80% recovery for the saturation of an emission current are 15 minutes for $Y_2O_3$, 13 minutes for $ThO_2$, and 6 minutes for $Y_2O_3$-doped $ThO_2$.

Resultingly, the fast recovery means that resistivity against poisoning is high. Therefore, the present invention to which $Y_2O_3$-doped $ThO_2$ is applied reduces the degradation loss caused by the reaction that alkaline earth metal oxide (especially, BaO) reacts chemically with gas remaining in CRT, thereby enabling to realize a high current density and a long endurance.

Figures 10, 11:
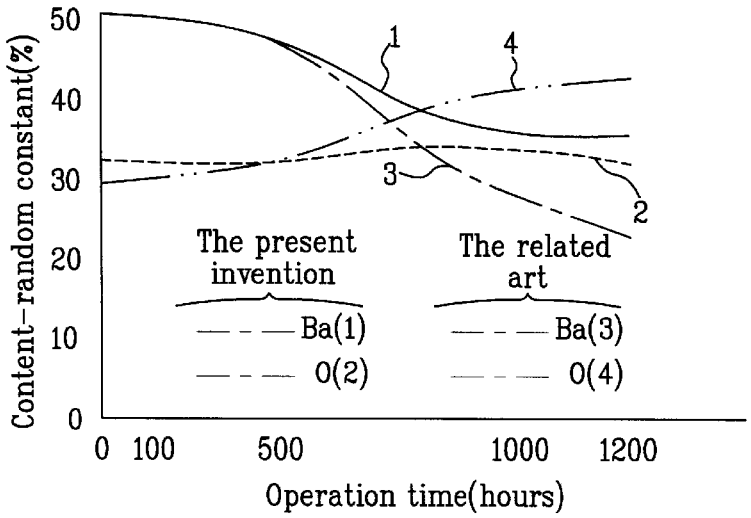

FIG. 10 illustrates a table of an AES(Auger electron spectroscopy) analysis for the relationship between a maximum cathode current and a BA content.

In AES, species and quantity of an element constructing a material surface are analyzed by measuring energy of Auger electron emitted by an electron beam which is focused into a size of tens nanometers so as to be incident on the surface.

Referring to FIG. 10, a variance of a maximum cathode current in accordance with an operation time has the same pattern of that of Ba at a surface in accordance with the operation time, which is because a quantity of Ba at the surface determines a quantity of electron emission.

Considering such a fact, the present invention has more Ba at the surface than the second related art in accordance with the operation time, thereby enabling to realize the current density and endurance higher and longer than those of the second related art, respectively.

FIG. 11 illustrates a graph of an AES analysis of content variation of Ba and oxygen at a surface according to an operating time.

As mentioned in the above description, the more oxygen is removed, the more free Ba is formed so as to increase emission electrons.

Referring to FIG. 11, a quantity of oxygen at a surface in the second related art increases continuously in accordance with operation time, while that of the present invention maintains almost uniform. Resultingly, the present invention carries out the removal of oxygen continuously for the operation endurance so as to form an electron emission source of the cathode stably.

Figure 12A:
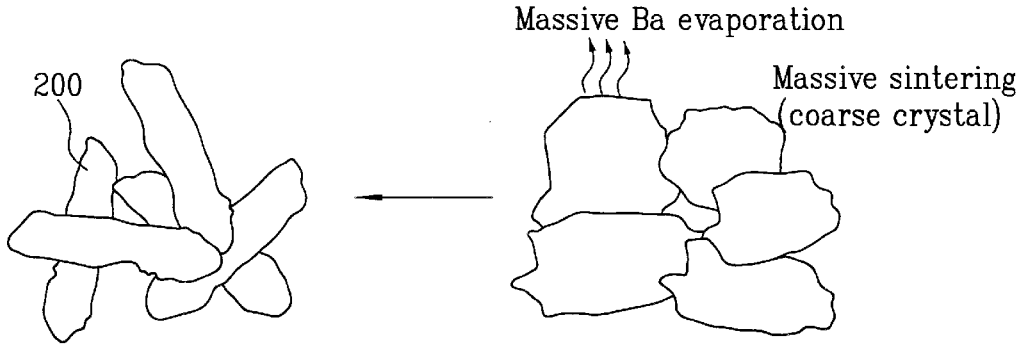
FIG. 12A and FIG. 12B illustrate mechanisms of cathodes in cathode ray tubes according to the present invention and related art, respectively.
Figure 12B:
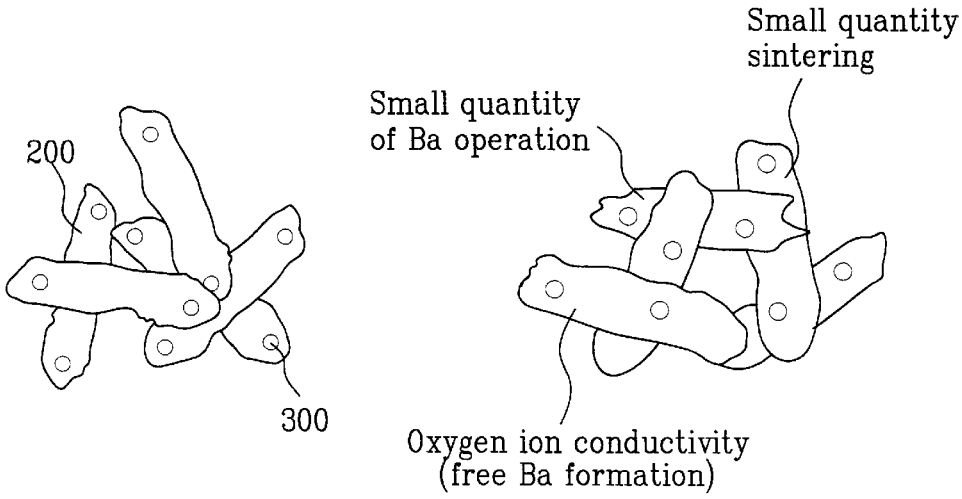

As mentioned in the above description, the cathode in CRT of the present invention has an endurance performance more excellent than that of the related art, which is clarified by the mechanisms shown in FIG. 12A and FIG. 12B.

FIG. 12A and FIG. 12B illustrate mechanisms of cathodes in cathode ray tubes according to the present invention and the first related art, respectively.

In the first related art, an evaporation quantity of Ba for operation endurance is big, and sintering progresses so as to make a crystal coarse. Yet, in the present invention, it is easy to remove oxygen owing to high oxygen ion conductivity for operation endurance so as to form an electron emission source of the cathode, has a less evaporation quantity of Ba, and bring about less sintering.

FIG. 13 illustrates a table of physical property of Ba and Th.

The reason why the present invention has less sintering of Ba is that melting heat, evaporation heat, and heat conductivity of Th, as shown in FIG. 13 are high.

The effects or advantages of the cathode in CRT according to the present invention are as follows.

The cathode in CRT according to the present invention helps to remove oxygen in the emission layer by high oxygen ion conductivity of plenty of oxygen vacancy by adding a small quantity of $Y_2O_3$-doped $ThO_2$ to the emission layer, thereby enabling to accelerate the formation of free Ba. The present invention prohibits the evaporation of Ba by high melting heat, evaporation heat, and heat conductivity of Th as a major additive in order to lessen the sintering of particle in the emission layer, thereby enabling to prevent the particle from becoming coarse. Therefore, the present invention enables to realize the cathode in CRT having a high current density and a long endurance.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A cathode in a cathode ray tube including a cathode sleeve having a heater inside, a base metal supported by the cathode sleeve so as to be formed at an upper end of the cathode sleeve, and an emission layer formed on the base metal, wherein the emission layer includes alkaline earth metal oxide and $Y_2O_3$-doped $ThO_2$.

2. The cathode of claim 1, wherein the alkaline earth metal oxide includes at least one of SrO, CaO, $Sc_2O_3$, and $Al_2O_3$ and BaO.

3. The cathode of claim 1 or claim 2, wherein the $Y_2O_3$-doped $ThO_2$ has a granularity between 0.5 and 2.5 $\mu$m.

4. The cathode of claim 1 or claim 2, wherein a doping concentration of $Y_2O_3$ in the $Y_2O_3$-doped $ThO_2$ is within 10 atom %.

5. The cathode of claim 1, wherein a content of the $Y_2O_3$-doped $ThO_2$ in the emission layer is between 0.01 and 0.10 weight %.

* * * * *